US005375375A

United States Patent [19]

Lee

[11] Patent Number: 5,375,375

[45] Date of Patent: Dec. 27, 1994

[54] WINDOW REGULATOR

[75] Inventor: Christopher Lee, Gurnee, Ill.

[73] Assignee: A.L. Hansen Mfg. Co., Waukegan, Ill.

[21] Appl. No.: 227,729

[22] Filed: Apr. 14, 1994

Related U.S. Application Data

[62] Division of Ser. No. 36,417, Mar. 25, 1993, Pat. No. 5,325,631.

[51] Int. Cl.[5] ..... E05F 11/48

[52] U.S. Cl. ..... 49/352; 49/353

[58] Field of Search ..... 49/348, 353, 360

[56] References Cited

U.S. PATENT DOCUMENTS

| | | | |
|---|---|---|---|
| 1,628,672 | 5/1927 | Kurscheidt et al. | 49/352 X |
| 4,306,378 | 12/1981 | Fukura et al. | 49/352 |
| 4,403,450 | 9/1983 | Ishii | 49/352 |
| 4,628,759 | 12/1986 | Kobayashi et al. | 49/352 X |
| 4,753,125 | 6/1988 | Fukumoto et al. | 49/352 X |
| 4,839,990 | 6/1989 | Lam et al. | 49/352 |

OTHER PUBLICATIONS

A. L. Hansen Mfg. Co. Drawing No. 89-30.

*Primary Examiner*—Philip C. Kannan

*Attorney, Agent, or Firm*—Willian Brinks Hofer Gilson & Lione

[57] ABSTRACT

A window regulator includes a rotatable hub that is coupled to a traveller by a cable, such that rotation of the hub raises and lowers the traveller. The hub is mounted on a driven gear which is rotated by a drive gear. The hub and the driven gear are concentrically mounted around a post, which defines an outer surface that is frictionally engaged by a coil spring that is coupled both to the driven gear and to the hub. The coil spring brakes rotation of the hub when the traveller is pushed downwardly. The drive gear and its associated bushings are removably mounted on the window regulator to allow easy replacement.

5 Claims, 5 Drawing Sheets

REST STATE (NO LOAD)

DRIVEN GEAR ROTATED CW

DRIVEN GEAR ROTATED CCW

BRAKE APPLIED

WINDOW REGULATOR

This application is a division of application Ser. No. 08/036,417, filed Mar. 25, 1993, now U.S. Pat. No. 5,325,631.

BACKGROUND OF THE INVENTION

This invention relates to a window regulator of the type used to raise and lower a window in a vehicle such as an automotive vehicle, and in particular to such a window regulator that has a long design life and an efficient braking system.

Window regulators are currently in wide spread use on vehicles such as cars and trucks. Conventional window regulators include a frame having a vertical guide portion which guides a traveller in movement between a raised position and a lowered position. A tension member such as a cable is secured to the traveller and passes around guide pulleys to a hub.

One type of window regulator employs a gear mechanism to rotate the hub. The hub is connected to a larger driven gear, which is driven by a smaller drive gear. The smaller drive gear in turn is rotated, typically by a manually operated crank arm or a motor.

In the past it has been conventional to use torsion springs positioned concentrically with the drive gear to engage an outer housing surrounding the gear, to form a type of drum brake. That is, the outer surface of the coil spring frictionally engages the inner surface of the surrounding housing to brake the window regulator and to prevent the weight of the window from causing the traveller to creep downwardly.

When window regulators of the type described above are used with unusually large, heavy windows certain wear problems are encountered. In particular, the bushings and the teeth of the drive gear may wear excessively. Furthermore, when the brake mechanism operates on the drive gear, the gear reduction provided by the gear linkage tends to make it more difficult for the brake to immobilize the traveller properly.

According, it is an object of this invention to provide an improved window regulator which can readily be serviced to provide extended life, and which provides a particularly efficient and effective brake mechanism.

SUMMARY OF THE INVENTION

According to a first aspect of this invention, a window regulator of the general type described above is provided with a post secured to the frame to extend toward the hub. A coil spring is dimensioned to engage the post frictionally, and this coil spring defines a first end portion coupled to the hub such that rotation of the hub in a first direction moves the first end portion in a coil spring tightening direction to cause the coil spring to grip the post and thereby to brake rotation of the hub.

According to a second aspect of this invention, a window regulator of the general type described above is provided with a retainer plate removably mounted to the frame to hold the drive gear in place on the frame, and a set of bushings removably mounted between the frame and the retainer plate to define a rotational axis for the drive gear. The retainer plate and the set of bushings are removable from the frame while the driven gear, the hub, the traveller, and the tension member all remain in their assembled positions, without disassembly of the frame, driven gear, hub, traveller or tension member. In this way the drive gear and the set of bushings can be readily removed and replaced to extend the life of the window regulator.

DETAILED DESCRIPTION OF THE PRESENTLY PREFERRED EMBODIMENTS

Figure 1:
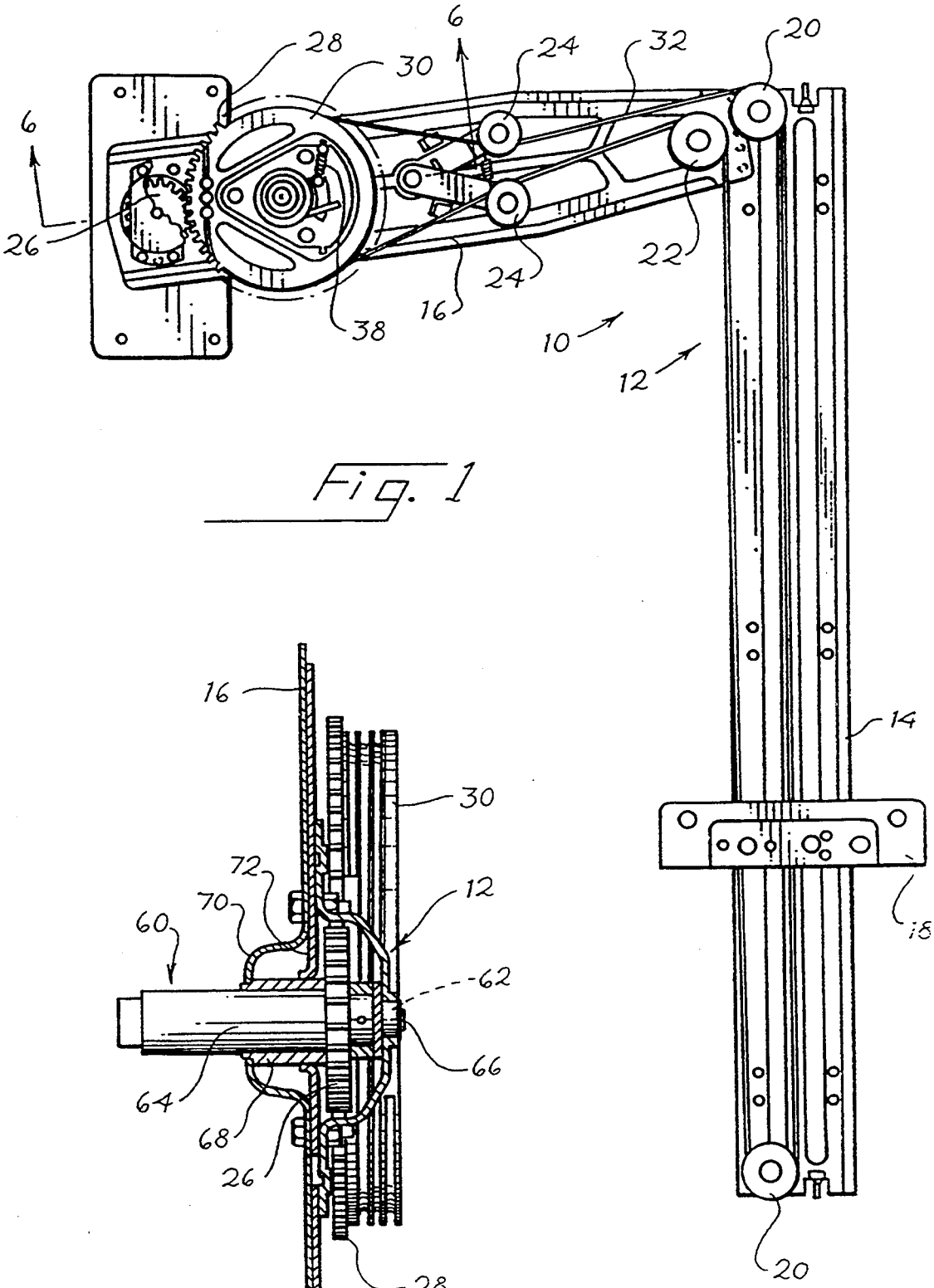
FIG. 1 is a front view of a window regulator that incorporates a presently preferred embodiment of this invention.
Figure 2:
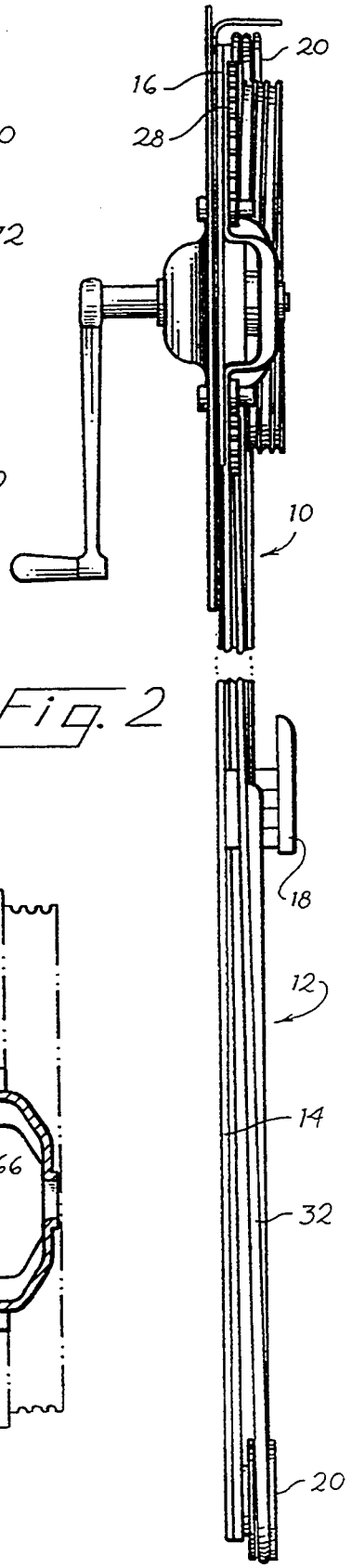
FIG. 2 is a side view of the window regulator of FIG. 1.

Turning now to the drawings, FIGS. 1 and 2 show overall views of a window regulator 10 that incorporates a presently preferred embodiment of this invention. The regulator 10 includes a rigid frame 12 that is generally L-shaped and includes a vertically oriented guide 14 and a transverse arm 16. The guide 14 is configured to guide a traveller 18 in vertical motion between an upper position (closely spaced to the arm 16) and a lower position (near the bottom of the guide 14). The traveller 18 is configured to support a window (not shown) in the door of a vehicle such as a truck or a car.

The guide 14 rotatably mounts two guide pulleys 20 as best shown in FIG. 1. The transverse arm 16 serves to mount a guide pulley 22, a pair of tensioning pulleys 24 and a drive mechanism. The drive mechanism includes a drive gear 26, a driven gear 28, and a hub 30 that is mounted to rotate with the driven gear 28 as described below. Typically a crank arm is mounted to the drive gear 26 to allow an operator to rotate the drive gear 26 manually, thereby rotating the driven gear 28. A tension member such as a cable 32 is secured to the hub 30 and the traveller 18 and is guided by the pulleys 20, 22, 24 such that rotation of the hub 30 in a counterclockwise direction (as shown in FIG. 1) raises the traveller 18, and rotation of the hub 30 in a clockwise direction (as shown in FIG. 1) lowers the traveller 18.

All of the above-described characteristics of the window regulator 10 are conventional in the art and therefore require no further description. These features have been described in order to clarify the structure and operation of the improved brake mechanism and drive gear mounting arrangement described below.

Figure 6:
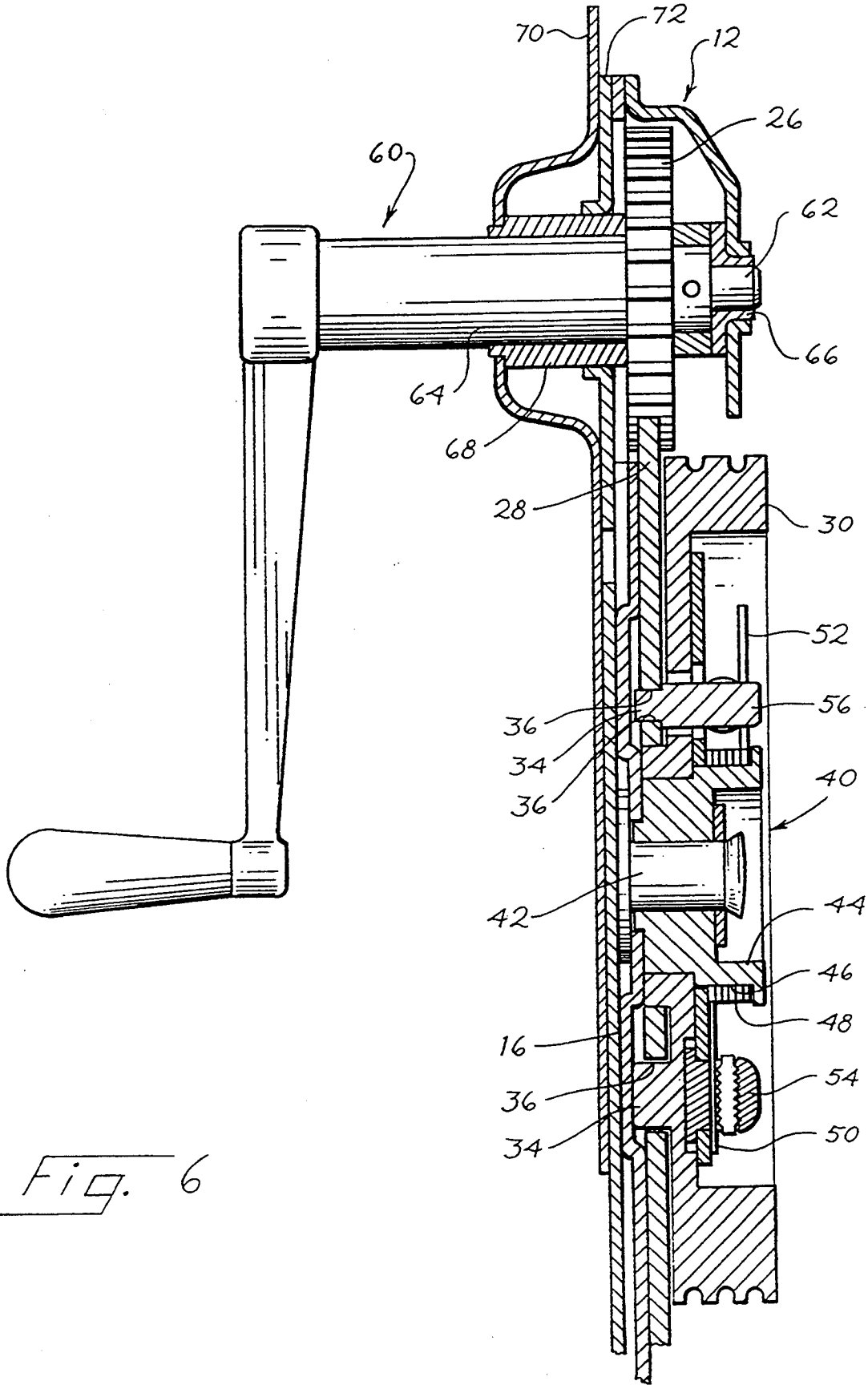
FIG. 6 is a cross-sectional view taken along line 6—6 of FIG.1.
Figure 7:
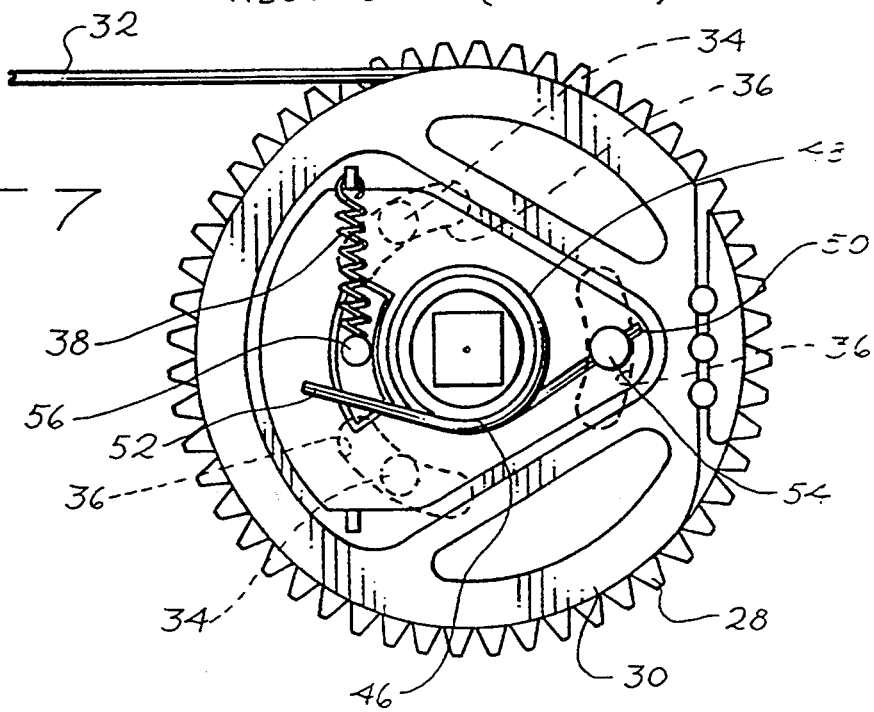
FIG. 7 is a schematic view showing the hub and driven gear of FIG. 1 in the rest state.
Figure 8:
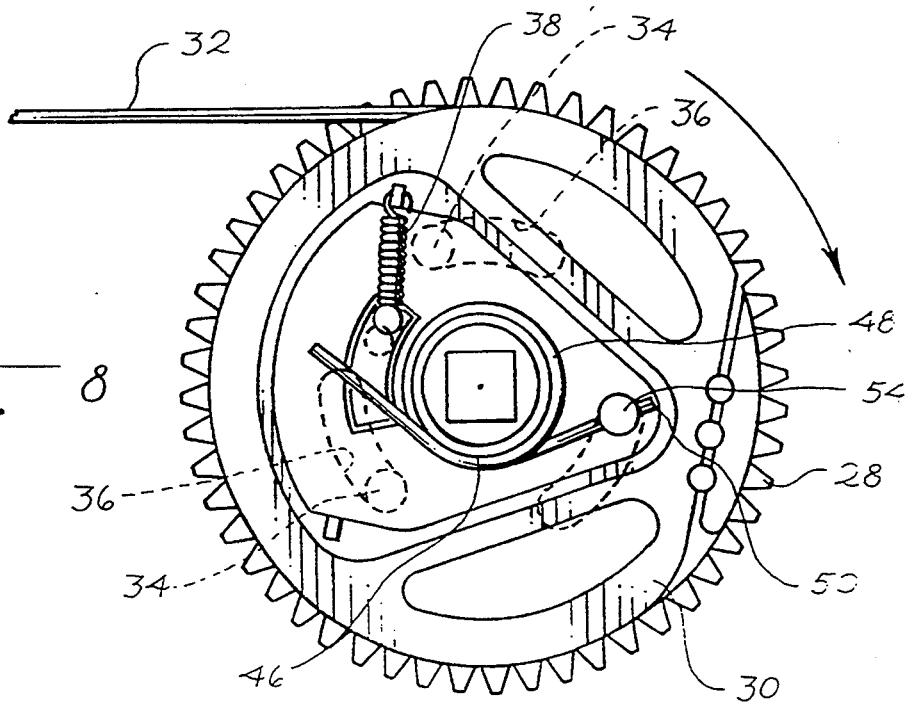
FIG. 8 is a schematic view of the components of FIG. 7 showing the driven gear rotated in the clockwise direction to raise the window.

As best shown in FIG. 6, the driven gear 28 is coupled to the hub 30 by a set of first stops 34 on the hub 30 and a set of second stops 36 on the driven gear 28. In this embodiment the first stops 34 are upstanding lugs as best shown in FIG. 6, and the second stops 36 are arcuate slots, as best shown in FIG. 7. With this arrangement the hub 30 is free to rotate through a limited arc with respect to the driven gear 28, but is caused to rotate with the driven gear 28 at the end of this limited arc. FIG. 7 shows the first stops 34 centrally positioned in the slots of the second stops 36, while FIG. 8 shows the first stops 34 at one end of the second stops 36. A spring 38 is interconnected between the driven gear 28 and the hub 30 to bias the hub 30 to the central position of FIG. 7.

Returning to FIG. 6, the hub 30 is mounted for rotation on a post 40 that is rigidly secured to the transverse arm 16 of the frame 12. In this embodiment the post 40 includes a central element 42 and an outer sleeve 44, and the sleeve 44 is prevented from rotating by the element 42. The outer sleeve 44 defines an outwardly facing surface 46 that in this embodiment is cylindrical.

As best shown in FIGS. 6 and 7, a coil spring 48 that acts as a friction brake is disposed around the outer sleeve 44 in frictional engagement with the outwardly facing surface 46. This coil spring 48 defines a first end 50 and a second end 52 (FIG. 7). The first end 50 is fixedly mounted to the hub 30 by a mounting lug 54, while the second end 52 is selectively engaged with the driven gear 28 by means of a lug 56.

FIGS. 7—10 illustrate the operation of the brake formed by the coil spring 48. As shown in FIG. 7, in the rest or no load position, the spring 38 positions the hub 30 in a central position with respect to the driven gear 28. In this position the coil spring 48 lightly engages the outwardly facing surface 46.

As shown in FIG. 8, when the driven gear 28 is rotated in the clockwise direction (in the view of FIG. 8) by the drive gear 26 (FIG. 1), the mounting lug 54 moves the first end 50 in a coil spring loosening direction to open up the coil spring 48 and free the coil spring 48 from frictional engagement with the outwardly facing surface 46. In this way the brake formed by the coil spring 48 is released when the driven gear 28 is rotated to raise the window.

Figure 9:
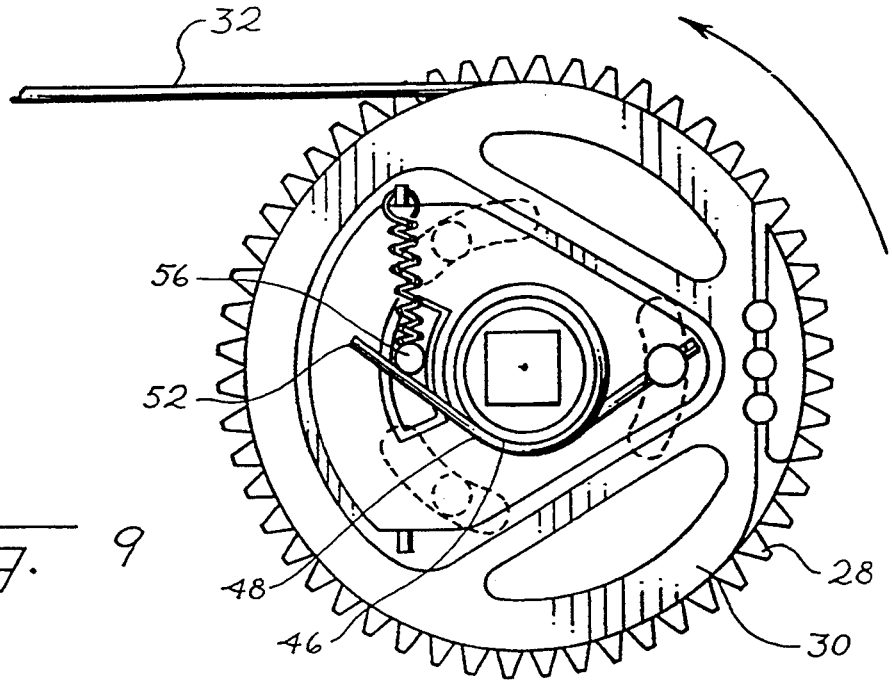
FIG. 9 is a schematic view of the components of FIG. 7 showing the driven gear rotated in the counter-clockwise direction to lower the window.

Similarly, as shown in FIG. 9 the brake formed by the coil spring 48 is released when the driven gear 28 is rotated in the counter-clockwise direction to lower the window. When this happens the lug 56 on the driven gear 28 bears against the second end 52 of the coil spring 48 and moves it in a coil spring loosening direction so as to open up the coil spring 48 and eliminate frictional engagement between the coil spring 48 and the outwardly facing surface 46.

Figure 10:
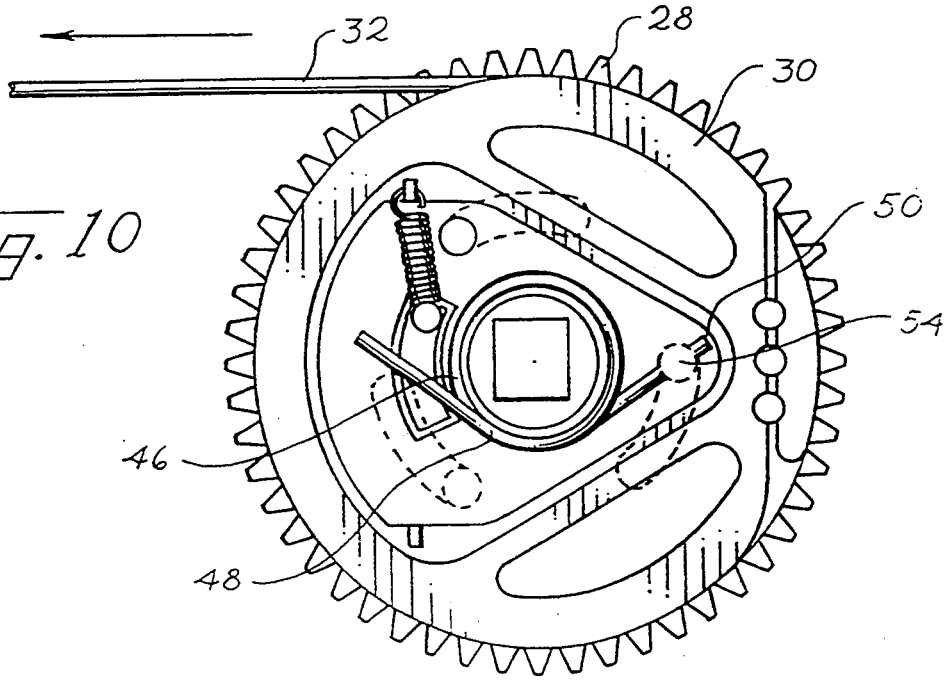
FIG. 10 is a schematic view of the components of FIG. 7 showing the brake applied by downward force on the traveller and the tension member.

FIG. 10 shows that in the event a downwardly directed force is applied to the traveller 18 (FIG. 1), tension on the cable 32 tending to rotate the hub 30 in the counter-clockwise direction (as shown in FIG. 10) causes the mounting lug 54 to move the first end 50 of the coil spring 48 in a coil spring tightening direction. This causes the coil spring 48 to grip the outwardly facing surface 46 securely, which prevents further rotation of the hub 30 and thereby immobilizes the cable 32.

The brake mechanism described above provides a number of important advantages. First, since the brake formed by the coil spring 48 operates on the driven gear 28, the speed reduction provided by the gear linkage made up of the drive gear 26 and the driven gear 28 does not operate to increase torque applied to the brake. Second, the driven gear 28 is often longer lived than the drive gear 26, because it has a larger number of teeth which are used less frequently. This means that if the drive gear 26 and the driven gear 28 are of comparable tooth hardness, the disclosed placement of the coil spring 48 in a concentric relationship with respect to the driven gear 28 allows the drive gear 26 to be readily removed without disturbing the coil spring 48.

Figure 3:
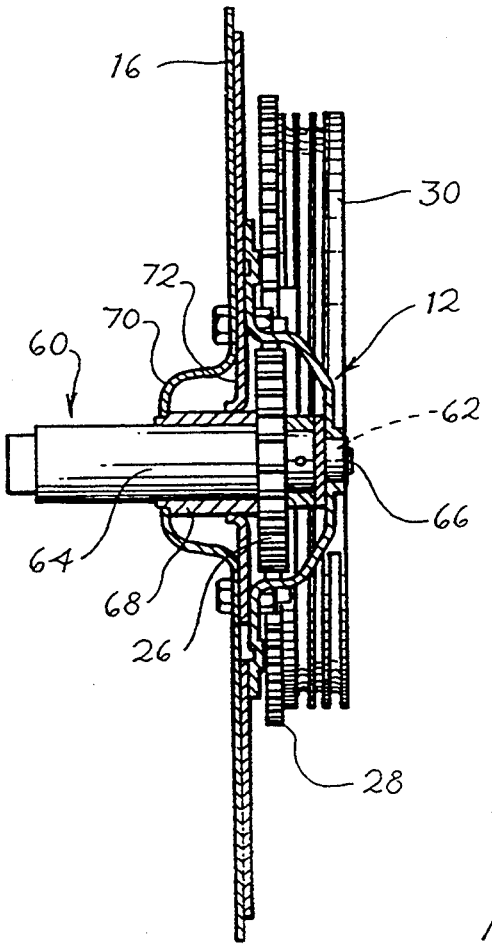
FIG. 3 is an enlarged side view of an upper portion of the mechanism of FIG. 1.
Figure 4:
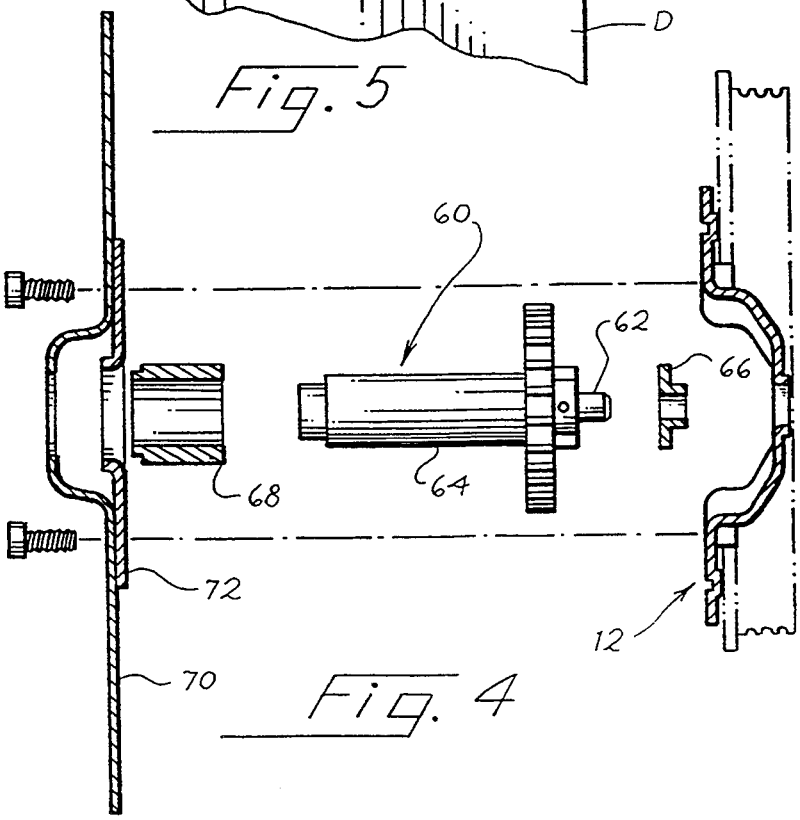
FIG. 4 is an exploded view of the components of FIG. 3.

FIGS. 3–6 relate to another important feature of the window regulator 10. As shown in FIGS. 3 and 4, the drive gear 26 is mounted to the arm 16 of the frame so as to allow ready removal of the drive gear 26. In particular, the drive gear 26 is mounted on a shaft 60 that defines first and second guide surfaces 62, 64. Each of the guide surfaces 62, 64 is received in a respective bushing 66, 68. The smaller bushing 66 is removably mounted in a portion of the frame 12. The larger bushing 68 is removably mounted in a cover plate 70 and a retainer plate 72. The frame adjacent to the retainer plate 72 is configured such that the drive gear 26 including the shaft 60 as well as the bushings 66, 68 can readily be removed from one side of the frame 12 after the cover plate 70 and retainer plate 72 have been removed.

Figure 5:
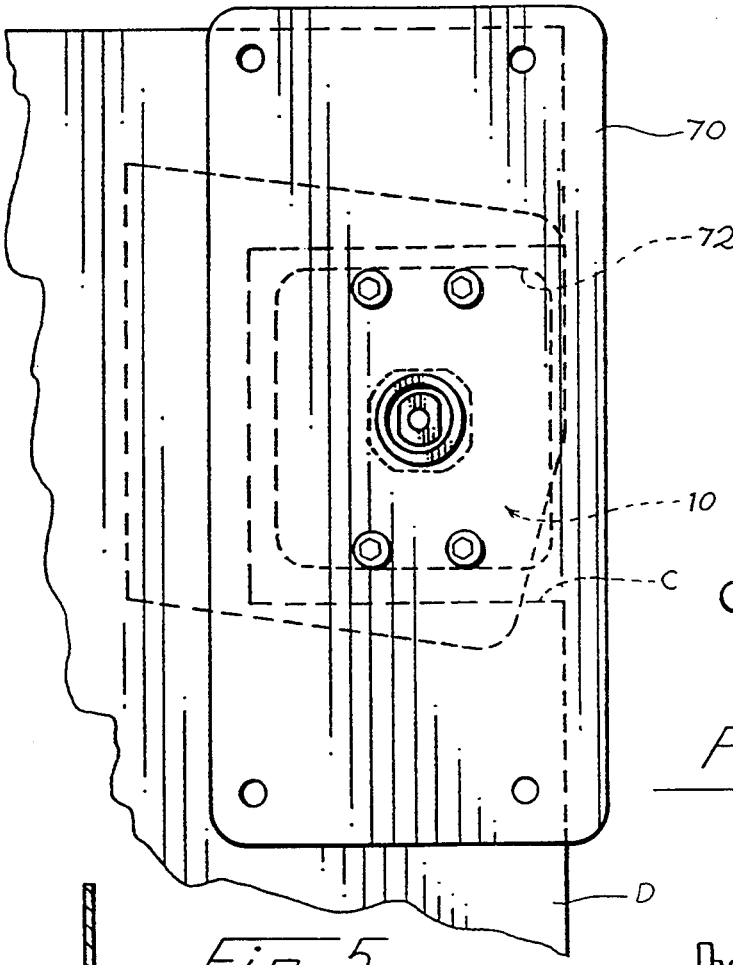
FIG. 5 is an enlarged rear view showing portions of the window regulator of FIG. 1 mounted on a door of a vehicle.

FIG. 5 illustrates the manner in which these components of the window regulator 10 can be used to facilitate removal and replacement of the drive gear when worn. As shown in FIG. 5, the window regulator 10 is mounted within a door D of a vehicle, and this door D defines a cutout C. The cutout C is larger than the retainer plate 72, but smaller than the cover plate 70.

If after extensive use the drive gear or the bushings become worn, the cover plate 70 can be removed to expose the cutout C, and the retainer plate 72 can be removed through the cutout C. Once this has been accomplished the drive gear 26, the shaft 60 and the bushings 66, 68 (FIG. 4) can all be removed via the cutout C (FIG. 5), without any further disassembly of the frame 12, the driven gear 28, the hub 30 or the cable 32 (FIG. 1). It is then a simple matter to replace the drive gear 26 and the bushings 66, 68 with new components, and then to reassemble the cover plate 70 and the retainer plate 72. All this can readily be accomplished without any disassembly of the door D or other components of the window regulator 10. It should be noted that the replaceable drive gear 26 cooperates with the coil spring 48 because the coil spring 48 is positioned on the driven gear 28 rather than the drive gear 26, the coil spring 48 does not interfere with or complicate replacement of the drive gear 26 (FIG. 6).

The following details of construction are provided merely to elaborate on the best mode contemplated by the inventor, and these details are not intended in any way to limit the scope of the following claims. Simply by way of example, the bushings 66, 68 can be formed of a suitable powered metal infiltrated with copper so as to be self lubricating. The gears 26, 28 can be stamped of steel plate and then heat treated to case harden them to a hardness on the Rockwell C Scale in the range of 50–55. The outwardly facing surface 46 can be made of steel or powdered metal and should preferably be case hardened and then carbonized or nitrided to a depth of at least 0.015" to provide a hardness of about 58 on the Rockwell C Scale. The coil spring 48 should preferably be formed of rectangular section wire having a height measured radially approximately three times the width and formed of spring steel which is heat treated and hardened to a hardness of approximately 42–50 on the Rockwell C Scale.

The cable 32 is preferably a galvanized steel cable made up of seven strands, each formed of seven filaments. The cable 32 is coated with nylon and has a final diameter of about 0.094". In this example the driven gear has 52 teeth, the drive gear 26 has 17 teeth, and the resulting gear ratio is 3:1.

Of course, it should be understood that a wide range of changes and modifications can be made to the preferred embodiment described above. For example, the brake described above can be used with a conventional drive gear, and the replaceable drive gear described above can be used with a conventional brake. It is therefore intended that the foregoing detailed description be regarded as illustrative rather than limiting, and that it be understood that it is the following claims, including all equivalents, which are intended to define the scope of this invention.

I claim:

1. In a window regulator of the type comprising:

a frame; a traveller guided for movement along the frame and configured to support a window such that movement of the traveller along the frame opens and closes the window; a pair of guide pulleys, each positioned near a respective edge of the frame; a hub mounted on the frame for rotation, a gear linkage comprising a driven gear mounted for rotation with the hub and a drive gear mounted to the frame in engagement with the driven gear; and a tension member coupled to the hub and the traveller and guided by the guide pulleys to cause the traveller to move along the frame in response to rotation of the hub; the improvement comprising:

a retainer plate removably mounted to the frame to hold the drive gear in place on the frame;

a set of bushings removably mounted between the frame and the retainer plate to define a rotational axis for the drive gear;

said retainer plate and set of bushings removable from the frame while the driven gear, hub, traveller, and tension member remain in their assembled positions, without disassembly of the frame, driven gear, hub, traveller or tension member to allow ready removal and replacement of the drive gear and the set of bushings to extend the life of the window regulator.

2. The invention of claim 1 wherein the retainer is covered by a cover plate which is larger in area than the retainer.

3. The invention of claim 1 wherein the drive gear is mounted on a shaft that defines first and second guide surfaces on respective sides of the drive gear; wherein the set of bushings comprises a first bushing in engagement with the first guide surface and a second bushing in engagement with the second guide surface; wherein the first bushing is captured between the drive gear and the frame; and wherein the second bushing extends between the drive gear and the retainer.

4. The invention of claim 1 wherein the window regulator is mounted in a door, wherein the door defines a cutout which is configured to allow the retainer, the drive gear, and the set of bushings to be removed from the door through the cutout.

5. The invention of claim 4 wherein the retainer is covered by a removable cover plate which is larger than the retainer and the cutout.

* * * * *